US006588892B1

(12) United States Patent
Stramel et al.

(10) Patent No.: US 6,588,892 B1
(45) Date of Patent: Jul. 8, 2003

(54) RECORDING INK ONTO PRINT MEDIA

(75) Inventors: Rodney D. Stramel, San Diego, CA (US); Scott W. Hock, Poway, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/062,735

(22) Filed: Jan. 31, 2002

(51) Int. Cl.[7] ..... B41J 2/01

(52) U.S. Cl. ..... 347/102; 347/18; 347/156; 347/101

(58) Field of Search ..... 347/100, 102, 347/97, 18, 156, 101; 34/60, 92

(56) References Cited

U.S. PATENT DOCUMENTS 4,490,731 A * 12/1984 Vaught ..... 347/99
5,043,741 A * 8/1991 Spehrley, Jr. ..... 347/99
6,293,638 B1 * 9/2001 McDonald ..... 347/102

* cited by examiner

*Primary Examiner*—Craig Hallacher
*Assistant Examiner*—Manish S. Shah

(57) ABSTRACT

An inkjet recording apparatus and method are disclosed. The apparatus includes a print recording source, which ejects wet ink onto a print media, and container, which ejects a supercooled gas onto the media in order to freeze-dry the wet ink. The methods include ejecting wet ink onto recording medium and freeze drying the ink on the medium. Also the supercooled gas is pass across a portion of the media either before or after wet ink received on the medium.

27 Claims, 2 Drawing Sheets

FIG. 4
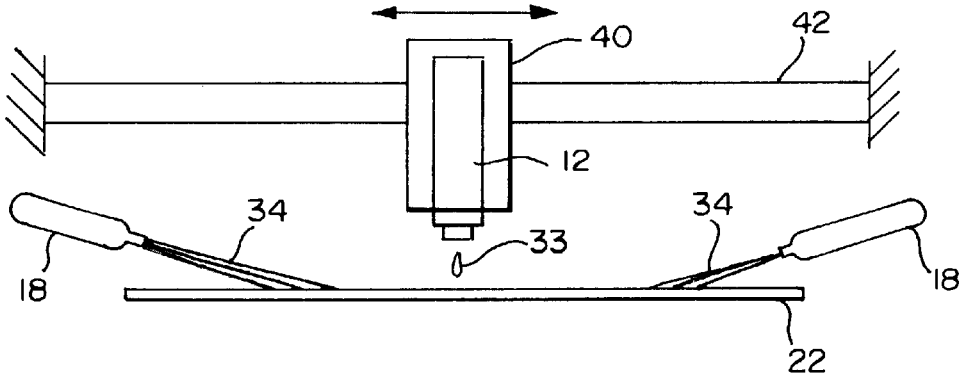
FIG. 5
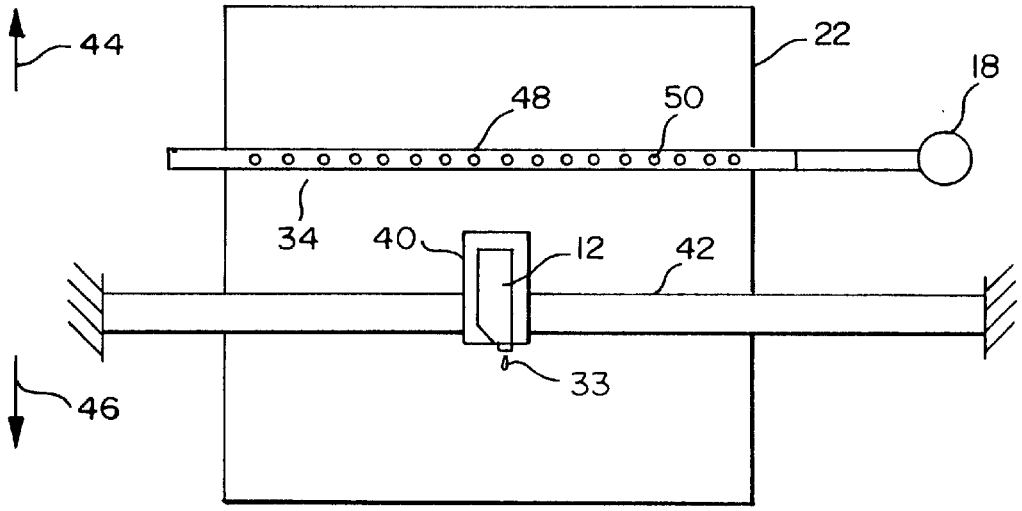
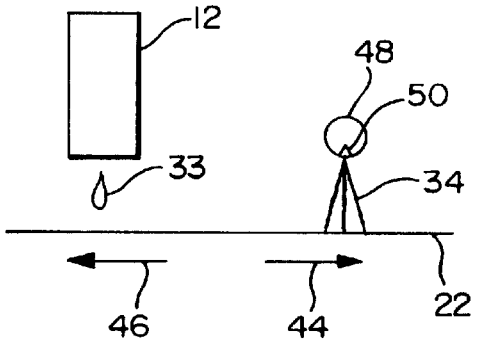
FIG. 6
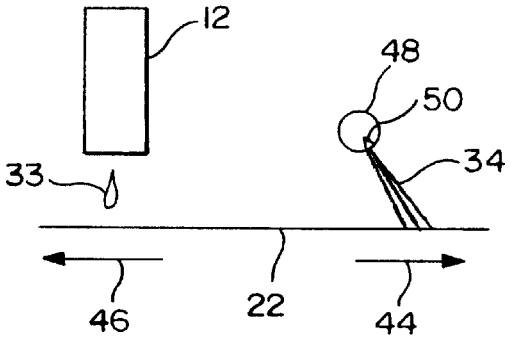
FIG. 7

RECORDING INK ONTO PRINT MEDIA

BACKGROUND OF THE INVENTION

This invention relates generally to ink recording methods, and more particularly, to methods for drying wet inks printed onto a media sheet.

Many inks, including thermal inkjet inks, are composed of a substantial amount of water. During print recording, ink drops are ejected onto a media sheet, wetting the media sheet. The recorded ink dries by evaporation of the liquid content leaving the ink resins remaining as a recorded marking. Conventionally, the evaporation occurs by letting the inked media sheet stand at ambient temperature.

While the ink remains wet on the media sheet, there is a risk of smearing the ink and thus losing the quality of the recorded marking. Thus, the drying time of the ink effects when the next media sheet can be printed. In particular, the drying time for wet ink printing often is a significantly limiting factor to print throughput speed. One approach for achieving improved print throughput speed has been to include a one-sheet buffer area. The buffer is formed by output rails. When a media sheet is printed, it is moved along the output rails where it is suspended above an output tray. By doing so, the top sheet in the underlying output stack is given additional time to dry. When the next sheet is printed, the prior sheet is dropped onto the output stack giving this next sheet additional time to dry. This partially offsets the negative impact that drying time has on print throughput speed. However, drying time still is a significantly limiting factor in print throughput speed. As the desire for still faster print throughput speeds continues, additional techniques are needed. It is known to use a heater and/or fan to speed up the drying process. Heating is an effective method for reducing the evaporation time. A disadvantage of these approaches i s the energy cost of generating the heat or powering the fan.

SUMMARY OF THE INVENTION

In a method and apparatus where ink is recorded onto a media, the ink is freeze-dried on the media.

BRIEF DESCRIPTION OF THE DRAWINGS

FIG. 4 is a diagram of a carriage which scans a media sheet carrying the print recording device, while the cooling source is independently located;

FIG. 5 is a diagram of a portion of a print recording system in which supercooled gas is emitted from a manifold fixed above a media path.

FIG. 6 is a diagram of the manifold and print recording source in which manifold openings are arranged to define a path of gas flow.

FIG. 7 is another diagram of the manifold and print recording source in which manifold openings are arranged to define a path of gas flow.

DESCRIPTION OF SPECIFIC EMBODIMENTS

Figure 1:
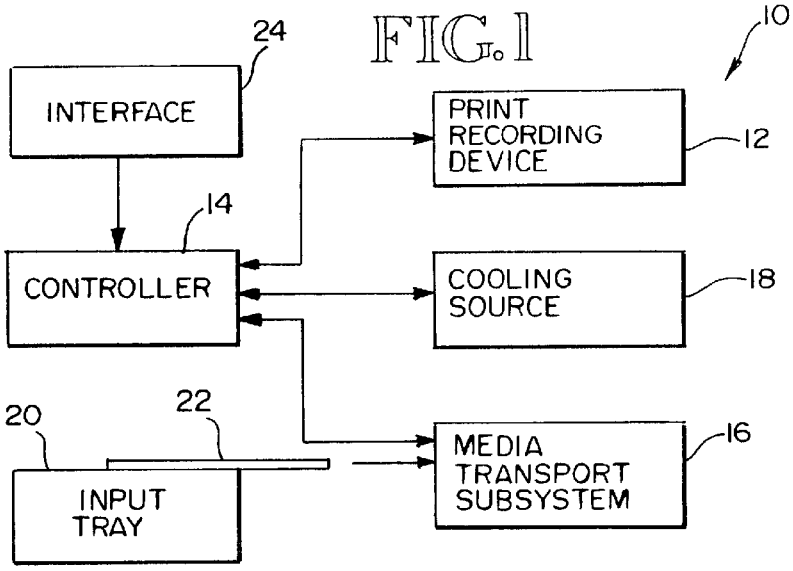
FIG. 1 is a block diagram of a print recording system according to an embodiment of this invention.

A print recording system 10, such as an inkjet printer, a fax machine, or a copy machine is shown in FIG. 1. The system 10 includes a print recording device λ2, a controller 14, a media transport subsystem 16, and a cooling source 18. In some embodiments the system 10 also includes an input tray 20, including a stack of media sheets. A media sheet 22 is picked from the stack and then fed along a feed path by the media transport subsystem 16 toward a printzone. The printzone is adjacent to the print recording device 12 where ink is emitted from the print recording device 12 onto a portion of the media sheet. In other embodiments the media may be supplied in different formats. For example, in a plotter the media is often supplied on a roll and a cutting device severs the printed sheet from the roll.

Figure 2:
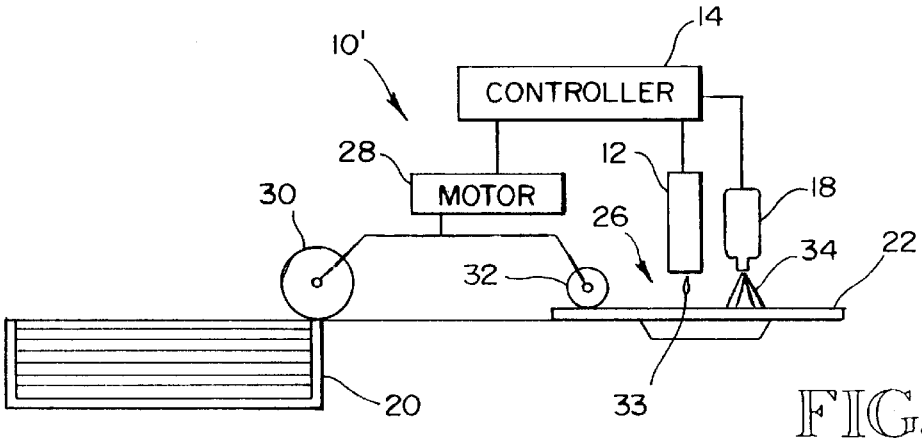
FIG. 2 is a simplified diagram of an embodiment of the print recording system of FIG. 1.

In operation, the system 10 responds to commands input at an interface 24, (e.g., a user input panel or an input from a host device to which the system 10 is coupled). For example, in a printer embodiment, a print job is downloaded through the interface 24 from a host computer. The controller 14 generates signals for completing the print job, coordinating the media transport subsystem 16, the print recording device 12 and the cooling source 18. Referring to FIG. 2, a media sheet is picked from a stack in the input tray 20 or an alternative feed source, and fed along a media path through a print zone 26 by the media transport subsystem 16. The subsystem 16 in one embodiment includes a motor 28, a pick and feed roller 30 and a guide roller 32. In other embodiments the subsystem 16 includes one or more rollers, media guides, a sensor and related devices involved in moving the media sheet from an input source location along a media path to receive ink recording, and further on to an output region. As the media sheet 22 passes adjacent to the print recording device 12, the portion of the media sheet within the printzone 26 receives ink recordings such as text, graphics or other symbols or symbol components.

In a preferred embodiment the cooling source 18 contains a compressed fluid (e.g., a liquid or a gas). In one embodiment the compressed fluid is a compressed liquified gas as stored in the container under pressure. In another embodiment the compressed fluid is a compressed gas stored in the container under pressure. In exemplary embodiments, the compressed fluid is compressed liquid nitrogen or compressed carbon dioxide. In alternative embodiments, any compressed liquified gas or compressed gas which cools to the freezing point of water upon expansion may be used.

The controller 14 coordinates emission of the fluid from the cooling source 18. As the fluid under pressure is emitted, it expands. In a preferred embodiment the emitted gas is a supercooled gas. The expanding fluid is in a gas state having a cool temperature at or below the freezing point of water. The cooled gas impinges the media sheet. In an embodiment where ink 33 is first recorded onto a portion of the media sheet 22, the cool gas 34 causes sublimation of the water component of the applied ink. Specifically, the water component freezes and sublimates into a gas state—in effect freeze-drying the ink on the media sheet 22 where exposed to the gas 34. The ink resins remain on the media as the ink recording. Other non-water based ink systems may also benefit from this cooling-drying system, such as inks having alcohol or other volatile carriers for the ink resins.

In comparison to a conventional heat drying process, for the cooling process, heat is not added to the media sheet to achieve drying. During cooling, energy is taken out of the system. Accordingly, the cooling process is more energy efficient. For the cooling process, there is less energy cost, although there is a material and assembly cost for the fluid and the fluid container.

Figure 3:
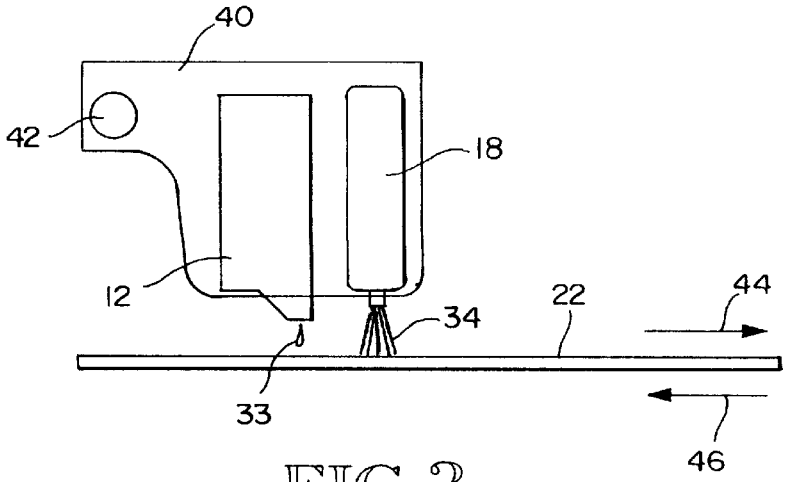
FIG. 3 is a diagram of a carriage which scans a media sheet carrying the print recording device and cooling source of FIG. 2.

Referring to FIG. 3, in one embodiment the cooling source 18 is carried with the print recording device 12 in a carriage 40. The carriage 40 moves along a rod 42 scanning the media 22 across the printzone. The print recording device 12 ejects drops onto a portion of the media sheet, while the cooling source 18 emits a supercooled gas which passes over an adjacent part of the media sheet. In a preferred embodiment the media sheet is advancing in a direction 44 with the gas 34 impinging on a portion of the media sheet 22 that already has received ink 33 from the print recording source 12. Note that for such an embodiment, the carriage 40 is traversing across the media sheet, which is illustrated in FIG. 3 as moving into and out of the plane of the drawing sheet. Preferably, the gas 34 is not directed into the ejection path of the ink 33.

In another embodiment the media sheet is advancing in a direction 46 with the gas 34 upstream of the ink drops 33, so that the gas 34 impinges onto the media sheet 22 before the ink 33. Preferably, the gas 34 is not directed into the ejection path of the ink 33. Thus, the ink 33 is applied to supercooled media.

Referring to FIG. 4, in still another embodiment, the cooling source 18 location is independent of the scanning of the print recording device 12. The print recording device 12 moves with the carriage 40 along a guide rod 42 scanning the media sheet 22. One or more containers form the cooling source 18 and emit the supercooled gas onto the media sheet 22. As illustrated, the media sheet is moving either one of into or out of the plane of the paper. Preferably the gas 34 is impinging on a portion of the media sheet 22 that already has received ink 33 from the print recording source 12. Alternatively, the gas 34 impinges onto the media sheet 22 before the ink 33. In such alternative case, the ink is freeze dried due to the coolness of the media sheet 22 as the ink drops 33 impinge on the cooled media sheet 22.

In the embodiments of FIGS. 3 and 4, it is preferred that the gas 34 is not directed into the ejection path of the ink 33. However, it is understood that the gas 34 by its nature will drift away from the directed path. Preferably, the directed path of the gas 34 is spaced far enough away from the ejection path of the ink 33 that the gas drifting into the path of the airborne ink drops is no longer at a freezing temperature.

In still another embodiment as shown in FIG. 5, the supercooled gas 34 is emitted through a manifold 48 which extends across the media sheet. The manifold 48 is coupled to the fluid source 18 and includes a channel through which the fluid flows. This embodiment illustrates one form of a detachable cooling cartridge which either may be refilled or replaced if supplied in a disposable format. The gas is output through a plurality of openings 50. The openings 50 define a fluid path directed toward the media sheet. In one embodiment (see FIG. 6) the path is directed straight down perpendicular to the media sheet. In another embodiment (see FIG. 7) the path is directed at an angle off the perpendicular and away from the print recording source 12. In alternate embodiments the cooling gas may be supplied from the underside of the media, opposite the print surface.

In one embodiment, the manifold includes one or more valves which are opened to allow the fluid to stream out toward the media sheet 22. The controller 14 provides a signal which controls the amount of opening and the time for which the valves are opened so as to control the amount and rate of fluid flow onto a given portion of the media sheet. For example, heavily ink-saturated photographic images may need more cooling than text or line drawings. The amount of opening and the time length of opening is predetermined to define a known rate of flow. The supercooled gas 34 is emitted from a short height (e.g., 1–50 mm) above the media sheet with the specific height varying according to the embodiment. In various embodiments the fluid release is pulsed or continuous while the media sheet passes beneath the manifold 48. In one embodiment where ink is first applied to a portion of the media sheet, the media sheet 22 is sprayed downstream from the printzone. In another embodiment the media sheet is cooled before receiving the ink. The ink is cooled when contacting the cooled media sheet.

Conclusion

The drying time for wet ink recording is significantly reduced. This allows print throughput speeds to improve. Furthermore, less energy is used to dry the ink, than for heat drying processes. In addition, bulky heater devices are avoided.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A method for recording ink onto print media, comprising:

ejecting wet ink onto the media;

freeze-drying the ink on the media; and passing a supercooled gas across a portion of the media before said portion receives wet ink during said ejecting.

2. A method for recording ink onto print media, comprising:

ejecting wet ink onto the media;

freeze-drying the ink on the media; and passing a supercooled gas across a portion of the media after said portion receives wet ink during said ejecting.

3. A method for recording ink onto print media, comprising:

advancing the media into a printzone;

ejecting wet ink onto the media; and freeze-drying the ink on the media.

4. A method for recording ink onto print media, comprising:

advancing the media into a printzone;

recording ink onto a portion of the media within the printzone;

exposing the media to a supercooled gas; and freeze-drying the ink on the media.

5. A method according to claim 4, wherein said exposing comprises exposing the recorded portion of the media to the supercooled gas.

6. A method according to claim 5, wherein said recording comprises recording ink onto said portion of the media within the printzone, said portion having been previously exposed to the supercooled gas.

7. A method according to claim 4, in which said exposing comprises:

ejecting a compressed fluid from a container, the compressed fluid expanding upon ejection forming the supercooled gas.

8. A method according to claim 7, in which said exposing comprises:

ejecting carbon dioxide from the container.

9. A method according to claim 7, in which said exposing comprises:

ejecting a compressed liquified gas from the container, the compressed liquified gas expanding upon ejection forming the supercooled gas.

10. A method according to claim 9, in which said exposing comprises:

ejecting nitrogen from the container.

11. An inkjet print recording apparatus, comprising:

a media handling system which moves print media toward and through a printzone;

a print recording source which ejects wet ink onto a portion of the media within the printzone;

a container which ejects a supercooled gas onto the media;

wherein wet ink recorded onto the media is freeze-dried.

12. An apparatus according to claim 11, wherein the container ejects the supercooled gas toward an area of the media prior to said area passing into the printzone, said supercooled gas cooling the media, and wherein wet ink recorded onto the cooled area of the media is freeze-dried due to temperature of the media.

13. An apparatus according to claim 11, wherein the container ejects the supercooled gas toward an area of the media after said area receives wet ink, said supercooled gas freeze-drying the ink onto the media.

14. An apparatus according to claim 11, wherein the container comprises a compressed fluid.

15. An apparatus according to claim 4, wherein the compressed fluid is a compressed liquified gas.

16. An apparatus according to claim 4, wherein the container comprises either one of carbon dioxide or liquid nitrogen.

17. An apparatus according to claim 11, further comprising a carriage which scans the media, the carriage holding the print recording source and the container wherein both the print recording source and the container scan the media, the print recording source ejecting ink onto a source-scanned portion of the media, the container exposing gas onto a container-scanned portion of the media.

18. An apparatus according to claim 15, wherein the source-scanned portion and the container-scanned portion are not coincident.

19. An apparatus according to claim 11, further comprising a carriage which scans the media, the carriage holding the print recording source, the container located independent of the carriage.

20. An inkjet recording apparatus, comprising:

means for ejecting wet ink onto print media;

means for freezing a water component of the ink into water crystals; and means for sublimating the water crystals into a vapor leaving a dried component of the ink on the media.

21. An inkjet print recording apparatus, comprising:

a media handling system which moves print media toward and through a printzone;

a print recording source which ejects wet ink onto a portion of the media within the printzone;

a container which ejects a supercooled gas onto the media, wherein wet ink recorded onto the media is freeze-dried; and a carriage which carries the print recording source and the container, wherein the carriage scans the media during ejection of the wet ink and the supercooled gas.

22. An apparatus according to claim 21, wherein the container comprises either one of carbon dioxide or liquid nitrogen.

23. A container which stores a fluid for use in freeze-drying inkjet ink in an inkjet printing mechanism, the container comprising a compressed fluid.

24. A container according to claim 23 which ejects the compressed fluid, the ejected fluid expanding into a supercooled gas.

25. An inkjet print recording apparatus, comprising:

a media handling system which moves print media along a media path toward and through a printzone;

a print recording source which ejects wet ink onto a portion of the media within the printzone;

a manifold extending across the media path and defining a plurality of openings, the manifold ejecting a supercooled gas onto the media;

wherein wet ink recorded onto the media is freeze-dried.

26. An apparatus according to claim 25, in which the supercooled gas is directed generally perpendicular to a surface of the media.

27. An apparatus according to claim 26, in which the supercooled as is directed oblique to a surface of the media.

* * * * *